US005135216A

United States Patent [19]

Bingham et al.

[11] Patent Number: 5,135,216

[45] Date of Patent: Aug. 4, 1992

[54] MODULAR RESISTANCE ASSEMBLY FOR EXERCISE MACHINES

[75] Inventors: Curt G. Bingham; S. Ty Meason, both of Logan, Utah

[73] Assignee: Proform Fitness Products, Inc., Logan, Utah

[21] Appl. No.: 647,554

[22] Filed: Jan. 29, 1991

[51] Int. Cl.[5] ..... A63B 21/04

[52] U.S. Cl. ..... 482/130

[58] Field of Search ..... 272/136, 137, 142

[56] References Cited

U.S. PATENT DOCUMENTS

| | | | |
|---|---|---|---|
| 3,312,466 | 4/1967 | Melchiona | 272/137 |
| 4,072,309 | 3/1984 | Wilson | 272/136 |
| 4,492,375 | 1/1985 | Connelly | 272/134 |
| 4,582,320 | 4/1986 | Shaw | 272/134 |
| 4,618,144 | 10/1986 | Gibson | 272/136 |
| 4,852,874 | 8/1989 | Sleichter et al. | 272/136 |
| 4,944,518 | 7/1990 | Flynn | 272/136 |
| 5,000,440 | 3/1991 | Lynch | 272/136 |

*Primary Examiner*—Richard J. Apley
*Assistant Examiner*—Lynne A. Reichard
*Attorney, Agent, or Firm*—Trask, Britt & Rossa

[57] ABSTRACT

A resistance assembly useful to provide resistance to exercise movements performed by a user on an exercise machine includes a pair of spool-like ends disposed within a resilient loop which passes around a portion of each spool end. Each spool end is configured as a hollow open-ended cylinder with planar, annular flanges extending from both ends of the cylinder. A shield extends from a segment of one of the annular flanges of each spool end. Each spool end is composed of first and second interfitting spool parts, each comprising a hollow open-ended cylinder with one of two flanges extending therefrom. The resistance of the assembly can be varied by exchanging the resilient loop for any of a plurality of loops having different resistive properties.

18 Claims, 4 Drawing Sheets

MODULAR RESISTANCE ASSEMBLY FOR EXERCISE MACHINES

BACKGROUND

1. Field:

This invention relates to exercise machines and more specifically to resistance assemblies useful in machines useful for performing multiple exercises.

2. State of the Art:

Exercise machines providing a selection of different strength conditioning exercises using various body limbs are known. Such machines may be used for "strength conditioning," which refers to the performance of exercises whose purpose or effect is largely to strengthen skeletal muscles. Such exercises usually involve the performance of relatively few repetitions of an exercise movement against moderate to high resistance. Strength conditioning may be referred to as a weight-training activity and also as an anaerobic exercise, since its principal focus is strength and not cardiovascular conditioning (aerobic).

In typical exercise machines useful for performing strength conditioning exercises, the resistance is provided by an arrangement of weights suspended from pulleys attached to the exercise bars which the user moves. The user's exercise movement thus raises or lowers the weights relative to the ground, and resistance is a function of the gravitational pull on the weights. The resistance is varied by changing the number and/or size of the weights suspended from the pulleys. Examples of strength conditioning exercise machines of such type include: U.S. Pat. Nos. 4,809,972 (Rasmussen et al.); 4,898,381 (Gordon); 4,902,006 (Stallings); 4,861,025 (Rockwell); 4,799,671 (Hoggan et al.); 4,930,768 (Lapcevic); 4,919,419 (Houston); 4,915,379 (Sapp); 4,900,018 (Ish et al.); and 4,915,377, 4,744,559 and 4,678,185 (Mahnke).

For many users, the regular performance of an exercise program is greatly facilitated by having an exercise machine at home. The weights-and-pulley devices identified above are regarded as particularly unsuitable for home use because they are very heavy and cumbersome. Furthermore, such machines may require complicated pulley configurations to provide a variety of exercises with a single machine. Moreover, there are safety problems of such devices, in that the pin typically used to select and hold the desired number of weights to the pulley can slip free during exercise, releasing the weights and causing possible injury to a user. Also, a user's hair, clothing, hands or limbs may become entangled in the pulleys or in the pin/weight arrangement.

Springs or spring cords have been suggested as a resistance device instead of weights and pulleys. U.S. Pat. No. 4,072,309 (Wilson). The springs or cords, and more recently a resilient strap or band, can be attached at one end to a fixed point on the exercise machine frame, and at another end to a point on an exercise bar. The resilient strap is made of an elastic material so that it can be stretched by applying a force tending to separate the two attachment ends of the strap. In the performance of exercises, the user moves the exercise bar so as to stretch the strap. The effective resistance to movement of a strap is variable, for example, according to the thickness of or the type of the resilient material. Variation of the effective resistance in the course of use may be accomplished by adding additional straps in the indicated configuration, or by substituting a strap having a different resistance. Such strap-and-machine arrangements have been sold by SOLOFLEX, Inc., Hillsboro, Oreg. One such strap appears to be illustrated in U.S. Pat. No. Des. 280,224 (Wilson).

The resilient strap resistance assembly is obviously much lighter in weight than the weights-and-pulley. However, there are safety problems with resilient strap assemblies. If the strap breaks, it may snap back against a user or become a projectile. A large inventory of straps must be maintained by the user in different sizes or weights to accommodate different exercises and different exercise programs. Also, the potential remains for a user's hair, clothing, or hands to become entangled with the strap near its point of attachment to the frame and the exercise bar.

A lightweight resilient strap resistance assembly for use with exercise machines which reduces the risk of entanglement, and reduces the potential for the strap to become a projectile, is needed. Further, there appears to be a need for an assembly in which the straps can be easily replaced or exchanged by the user and in which different strap arrangements are easily assembled.

SUMMARY OF THE INVENTION

A resistance assembly has a first connecting means for connection to a machine having movable structure movable by the user relative to fixed structure. The resistance assembly resists movement of the movable structure. The first connecting means of the resistance assembly is for connection to the machine at a first position on the movable structure. The second connecting means of the resistance assembly is for connection to the fixed structure of the machine at a second position spaced from the first position. The first position and the second position are movable relative to each other upon movement of the movable structure. A loop which is elastically deformable is removably positionable about the first connecting means and the second connecting means for elastic deformation upon relative movement of the first connecting means relative to the second connecting means to resist the relative movement therebetween.

In a preferred arrangement, the first connecting means includes securing means to secure the loop thereto. The second connecting means also preferably includes second securing means to secure the loop thereto.

In yet another preferred arrangement, the first connecting means has first shield means connected thereto to inhibit movement of the loop away from the first connecting means. Similarly, the second connecting means has second shield means connected thereto to inhibit movement of the loop away from the second connection means.

The machine in one configuration has a plurality of fixed extension members secured to the fixed structure of the machine. Each extension member is spaced from the other. The machine also has a structural extension member positioned on the movable structure; and the structural extension member is movable with the movable structure. The first connecting means has an aperture sized to snugly and slidably receive the structural extension member. The second connecting means has an aperture sized to snugly and slidably receive one of the fixed extension members. The fixed extension member and the structural extension member are both preferably cylindrically shaped fingers.

In a highly preferred arrangement, the first connecting means is a spool with a cylindrical aperture formed therein sized to slidably and snugly fit over the fixed extension members and the structural extension member. In the highly preferred configuration, the first securing means includes a first flange secured to one end of the spool and a second flange secured to the other end of the spool.

The first securing means preferably includes a first flange secured to the end of the spool to extend radially outwardly therefrom and a securing spool sized to slidably and snugly interconnect with the spool, the securing spool having a second flange appended thereto to extend radially therefrom.

The shield means may desirably be a surface mechanically connected selectively and alternately to the first flange and to the second flange to extend around a portion of the perimeter of the spool but spaced therefrom.

BRIEF DESCRIPTION OF THE DRAWINGS

In the drawings, which illustrate what is presently regarded as preferred embodiments.

DETAILED DESCRIPTION OF THE INVENTION

Figure 1:
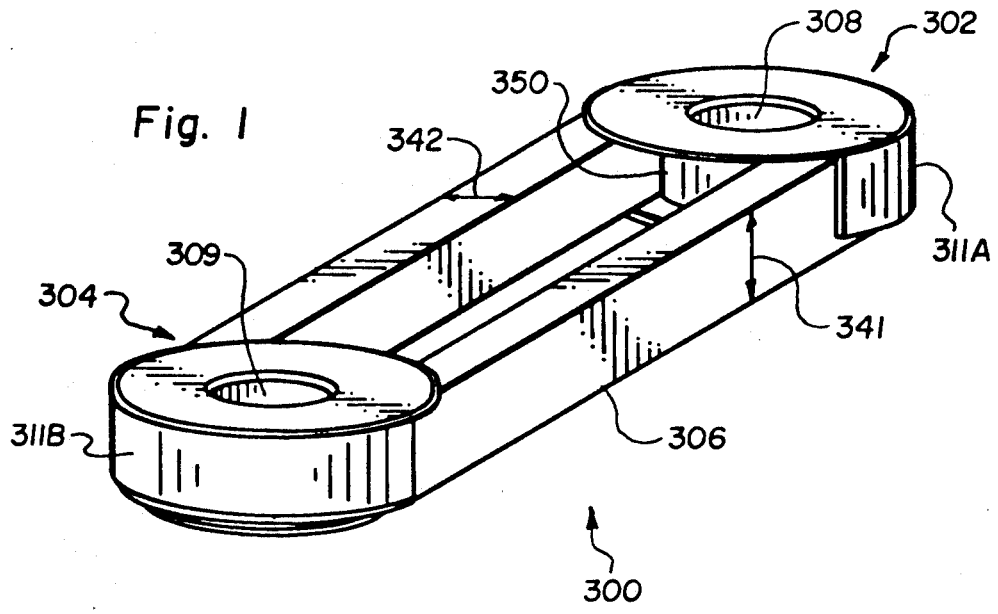
FIG. 1 is a perspective view of a resistance assembly of the invention.

In FIG. 1, a resistance assembly 300 is depicted for use with an exercise machine having movable structure for operation by a user. The movable structure is operated with respect to and relative to fixed structure of the machine.

The preferred resistance assembly has first connecting means 302 for connecting the resistance assembly to the movable structure of the exercise machine. It also has second connecting means 304 for connecting the resistance assembly to the fixed structure of the exercise machine. The resistance assembly also has a loop 306 which is formed to be elastically deformable. It is removably positionable about the first connecting means 302 and the second connecting means 304 for elastic deformation upon relative movement of the movable structure with respect to the fixed structure of the exercise machine. That is, one or more resistance modules 300 are connected to a machine to provide the user with selected resistance to exercise movements.

Figure 3:
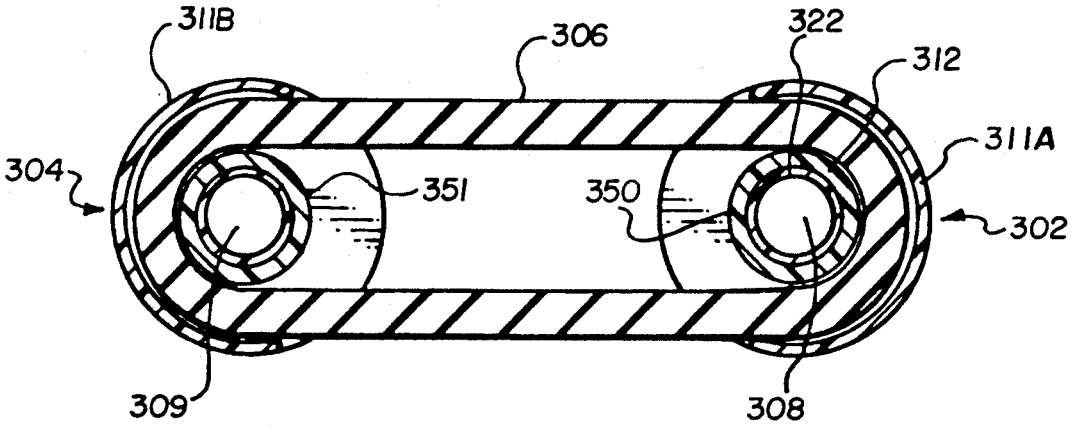
FIG. 3 is an elevational view of the detachable resistance module.

As shown in FIG. 1, the resistance assembly 300 comprises a pair of spool ends 302 and 304 which function as the first connecting means and the second connecting means. A resilient loop 306 has a first leg or stretch 306A and a second leg or stretch 306B. Each stretch 306A and 306B of the loop 306 has a thickness 342 and a height 341 (FIG. 1). The resilient loop 306 extends between the spools ends 302 and 304 which each have a cylindrical core 350 and 351 with central axial openings 308 and 309 best seen in FIG. 3.

Figure 6:
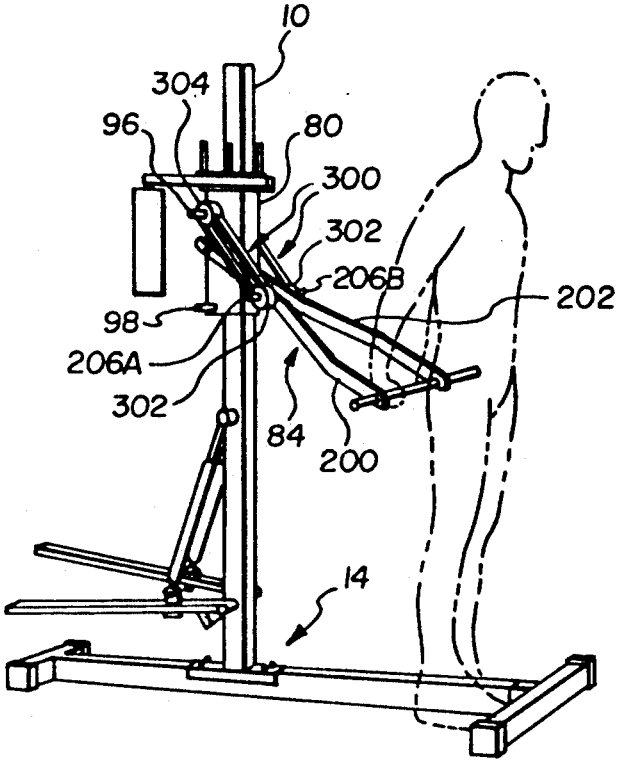
FIG. 6 shows a user exercising on an exercise machine having the detachable resistance modules in a first resistance configuration.
Figure 7:
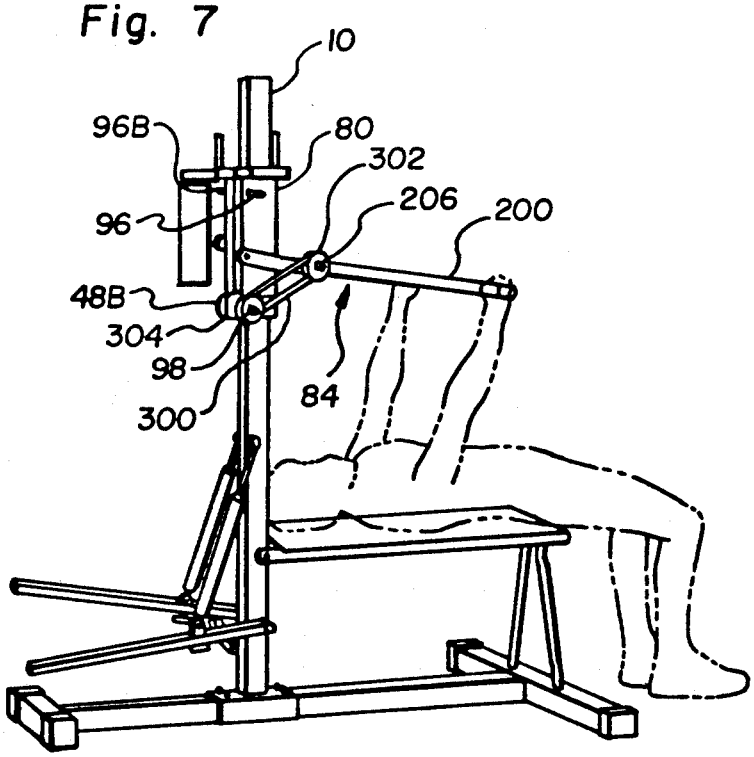
FIG. 7 shows a user exercising on an exercise machine with the detachable resistance modules in a second resistance configuration.

An example of a machine with which the resistance assembly 300 may be used is depicted in FIGS. 6 and 7. The machine has fixed structure such as the base support 14 and frame member !0. It has movable structure here shown as a lever having arms 200 and 202. The arms 200 and 202 are connected together and are pivotally mounted to a carriage 80 for movement by a user relative to the fixed structure such as frame member 10. The resistance assembly 300 of the invention is interconnected by the first connecting means and second connecting means to resist the relative movement of the arms 200 and 202 with respect to the fixed structure 10 and 14.

In the machine, a plurality of fixed extension members are secured to the fixed structure each spaced from the other. In the machine of FIGS. 6 and 7, the fixed extensions are fingers 96 and 98. They extend outwardly from the carriage on the side as shown in FIGS. 6 and 7 as well as on the opposite side 96B and 98B, only partially visible in FIG. 7.

The machine of FIGS. 6 and 7 also includes movable structure extension members which are spaced from the fixed extension members and mounted to the movable structure to move therewith relative to the fixed extension members. The movable structure extension members in the machine of FIGS. 6 and 7 are pins 206A and 206B. That is, openings 308 and 309 are sized to be snugly and slidably fit on the pins and fingers 96, 98, 206A, and 206B in FIGS. 6 and 7. All of the pins and fingers 96, 98, 206A and 206B are formed to have the same exterior cross-section and shape, although their respective lengths may vary. As a result, the openings 308 and 309 in both spool ends of each assembly 300 may have the same dimensions and in turn are reversible. That is, the connecting means 302 and 304 may be reversed when placed on the pins and fingers 96, 98, 206A and 206B. However, an assembly 300 can also be provided with a spool end 302 having an opening which is configured differently. For example, it may have a different shape or size and may be used to interconnect with attachment pins or fingers located on the machine different in shape or width from the fingers or pins 96, 98, 206A and 206B (FIGS. 6 and 7).

In the preferred embodiment of FIGS. 1-5, the spool ends 302 and 304 each have a shield 311A and 311B extending to partially enclose the resilient loop 306 in approximately the region which is in contact with the spool end (FIGS. 1-5). That is, the loop 306 has a portion which is in contact with the cylindrical core 350 for an arc 330 of approximately 180°, or one-half the perimeter 332 of the core 350.

Figure 5:
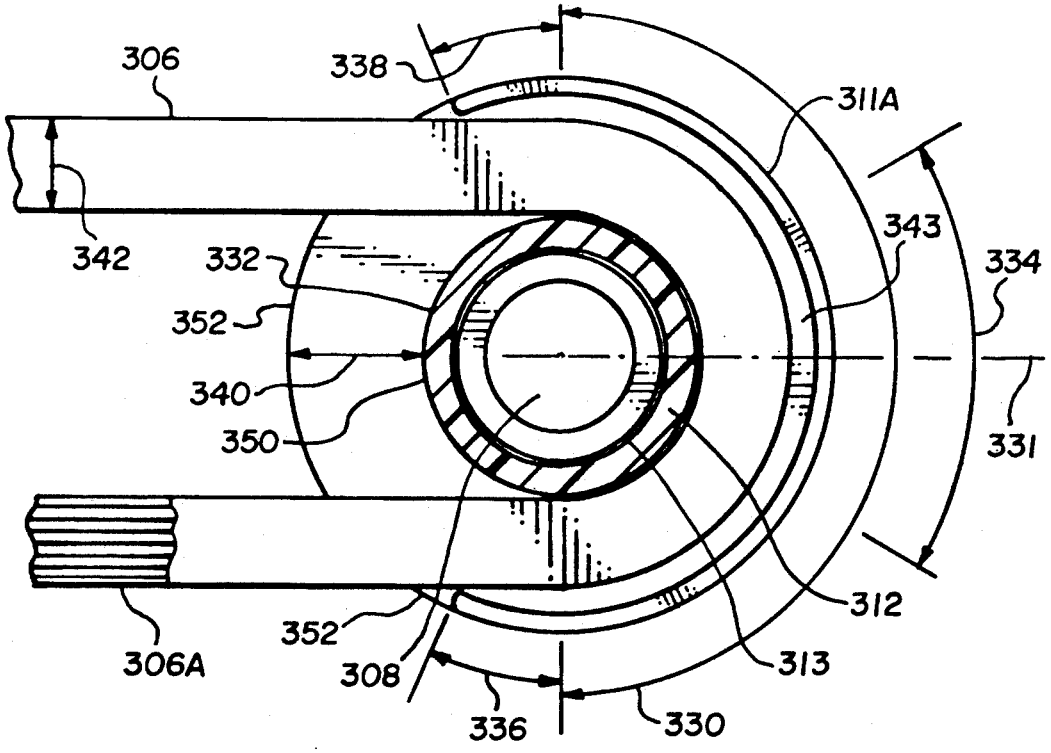
FIG. 5 is an elevational cutaway view of an end portion of the detachable resistance module.

As shown for the spool end 302 in FIG. 5, the shield 311A extends through an arc 334 selected to inhibit movement of the loop 306 should it break in use under tension. As shown in FIG. 5, a shield 311A is positioned on the side of the spool end 302 away from the loop 306. The arc 334 may be quite small and extend from less than 60° to an arc 230 of 180° and, as here shown, an additional about 50° in two approximate 25° portions 336 and 338. As can be seen, the arcs 330 and 334 are generally symmetrically positioned about horizontal axis 331.

In the event of breakage of the resilient loop 306, the shields 311A and 311B inhibit sudden release of a broken loop 306 from the resistance module 300. The risk of damage to persons and property from a broken loop 306 is thereby reduced. The shields 311A and 311B also help prevent a user's hair, clothing, and digits from becoming entangled with the resilient loop 306.

The spool ends 302 and 304 are also shown with a pair of flanges 352 and 353, and 354 and 355, connected thereto. The flanges 352, 353, 354 and 355 function as first securing means and second securing means to retain the loop 306 on or to the spool ends 302 and 304. The flanges 352 and 353 each extend radially outward a distance 340 preselected to be about half the thickness 342 of the thickest loop 306 to be used to easily retain the loop 306 on the spool ends 302 and 304 and more specifically on the cores 350 and 351. The flange 352 is specifically here shown to extend radially outward a distance 340 slightly more than the thickness 342 of the thickest loop 306 to facilitate placement of the loop 306 about the core 350 and within the cavity 343 formed by the core 350 and the shield 311A and core 351 and shield 311B. The flange 352 also acts to support the shield 311A. The flanges 354 and 355 are sized somewhat smaller than the flanges 352 and 353 and are selected to extend in radial length 344 more than half the thickness 342 of the loop 306. Such a size has been found to be sufficient to retain the loop 306 on the core 350 and 351.

Figure 2:
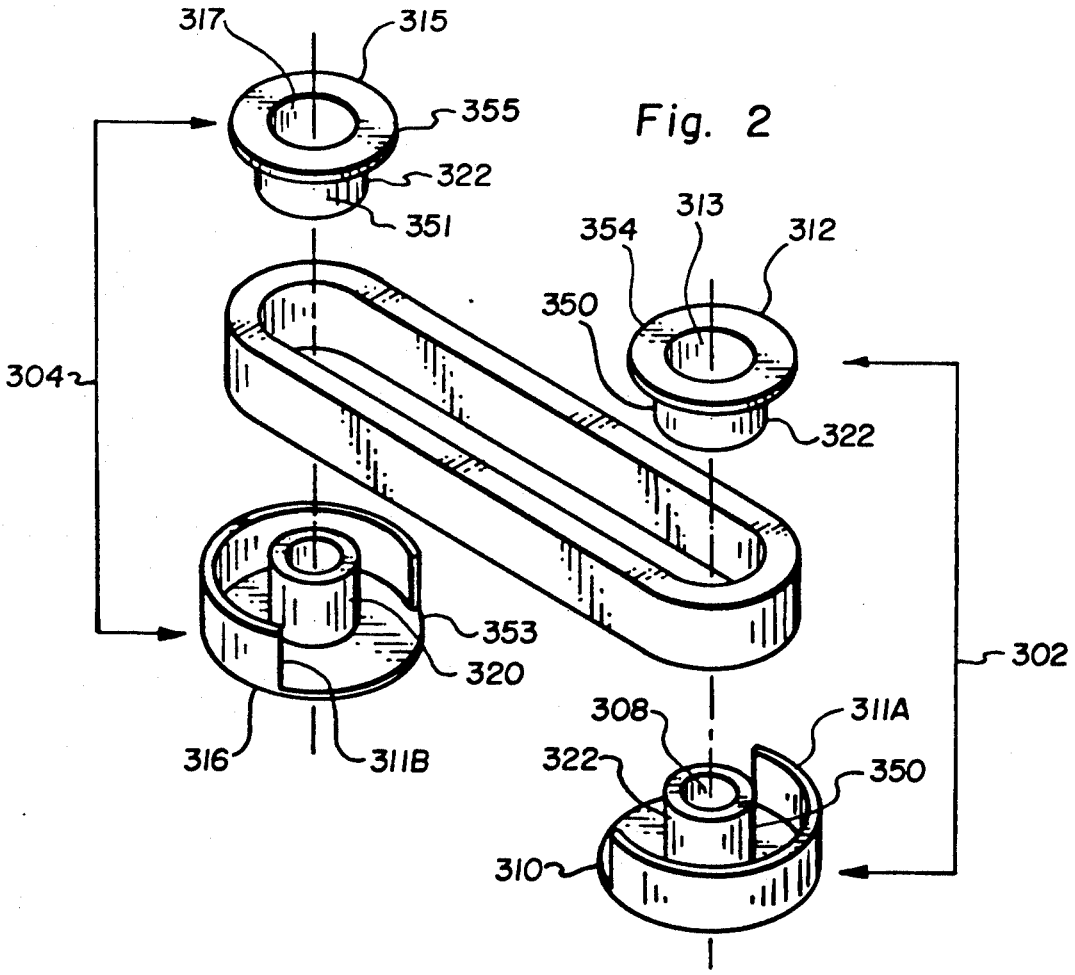
FIG. 2 is an exploded perspective view of the detachable resistance module.
Figure 4:
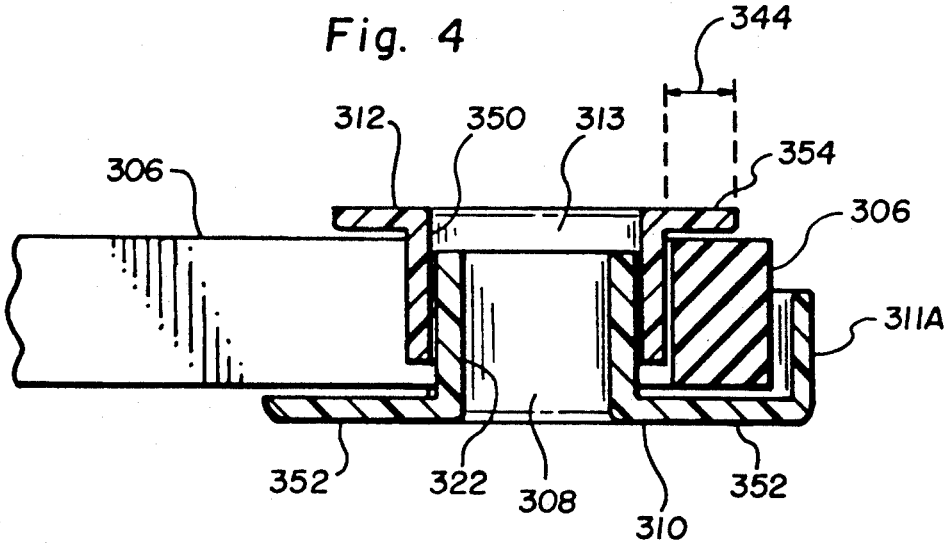
FIG. 4 is a side cutaway view of an end portion of the detachable resistance module.

As best seen in FIGS. 2 and 4, each spool end 302 and 304 has two parts 310, 312, 315 and 316 mutually sized to snugly slide together or apart. In FIG. 2, it is seen that the core portions 320 and 322 are sized to snugly and slidably receive parts 312 and 315. That is, the core portion 322 of part 310 fits slidably but snugly within the opening 313 of part 312. Parts 3!0 and 312 can thus be easily pulled apart and pushed together for replacement of the resilient loop 306. Moreover, the parts 310 and 312 can be easily manufactured from plastics by molding processes. In FIGS. 2 and 4, part 310 is shown to be the one having the shield 311A, but the shield 311A could instead be positioned on part 312.

Similarly, part 3!5 and 316 slidably and snugly fit together. The core portion 320 fits within aperture 317 of part 315. The parts 310, 312, 315 and 316 of the spool ends 302 and 304 may be made of any suitable rigid material, but are preferably made of plastic which is easy to manufacture and lightweight.

The resilient loop 306 may be made of any resilient material which can be stretched, but desirably may be vulcanized rubber. Loops may be made with different thicknesses to provide different resistance levels. Also, loops may be of different lengths as required by the dimensions and exercise pin or finger arrangements of different exercise machines or resistance configurations. Further, the loop 306 may be formed of multiple laminations or layers 306A (FIG. 5) which may be vulcanized into one unit.

FIGS. 6 and 7 illustrate the resistance modules 300 in use on an exercise machine having pins and fingers for mounting the resistance modules. FIG. 6 shows a first resistance configuration, for providing resistance to exercise with a lateral bar assembly 84 or lever in which a resistance assembly 300 is arranged to have one spool end 302 seated over pin 206A which extends outward from "Y"-shaped arm 200, and the other spool end 304 seated over a corresponding finger 96 which is effectively fixed relative to the pin 206 and is here shown on a carriage 80 repositionable on the frame member 10. A second resistance assembly is similarly disposed with respect to the opposite finger 96B and pin 206B.

An alternative resistance configuration is shown in FIG. 7. It has the first spool end 302 attached as previously described to the "Y"-shaped arm 200 via the pin 206A. The other spool end 304 is seated over the corresponding end of a second finger 98 spaced from finger 96. Similarly, a second resistance assembly (not visible in the view of FIG. 7) is similarly arranged with respect to the opposite ends of pin 206 and finger 98. A second resistance assembly is similarly disposed over finger 96B and pin 206B. This resistance configuration is useful to perform exercises such as triceps push-downs (FIG. 7), lat pull-downs, and others.

It will be evident from these examples that the resistance assembly can be arranged in a wide variety of resistance configurations, depending only on the particular assortment and arrangement of attachment pins and levers in a given exercise machine.

The disclosed configuration is not intended to limit the scope of the claims which themselves recite those features considered essential to the invention.

What is claimed:

1. For use with a machine having movable structure for operation by the user relative to fixed structure, a removably resistance assembly to resist movement of said movable structure, said removable resistance assembly comprising:

first connecting means for removably connection to said machine at a first position on said movable structure, said movable structure having first receiving means to receive said first connecting means;

second connecting means for removably connection to said machine at a second position on said fixed structure spaced from said first position, said first position and said second position being movable relative to each other upon movement of said movable structure, said fixed structure having second receiving means to receive said first connecting means; and a loop elastically deformable and positioned about the first said connecting means and said second connecting means for elastic deformation upon relative movement of said first connecting means relative to said second connecting means.

2. The resistance assembly of claim 1 wherein said first connecting means includes first securing means to retain said loop thereto.

3. The resistance assembly of claim 2 wherein said second connecting means includes second securing means to retain said loop thereto.

4. The resistance assembly of claim 3 wherein said first connecting means has first shield means connected thereto to inhibit movement of said loop away from said first connecting means, and second connecting means has second shield means connected thereto to inhibit movement of said loop away from said second connection means.

5. The resistance assembly of claim 4 wherein said resistance assembly is attached to said machine having a plurality of said second receiving means which are fixed structure extension members secured thereto each spaced from the other and a first receiving means which is a movable structure extension member positioned on said movable structure and movable therewith, and wherein said first connecting means has an aperture sized to snugly and slidably receive said movable structure extension member and wherein said second connecting means has an aperture sized to snugly and slidably receive one of said fixed structure extension members.

6. The resistance assembly of claim 5 wherein each fixed structure extension member is a cylindrically shaped finger and said movable structure extension member is a cylindrically shaped finger, and wherein said first connecting means is a spool with said aperture formed therein is a cylindrical aperture sized to slidably and snugly fit over said fixed structure extension member and said movable structure extension member.

7. The resistance assembly of claim 6 wherein said first securing means includes a first flange secured to one end of said spool and a second flange secured to the other end of said spool.

8. The resistance assembly of claim 6 wherein said first securing means includes a first flange secured to one end of said spool to extend radially outward therefrom, and a securing spool sized to slidably and snugly interconnect with said spool, said securing spool having a second flange appended thereto to extend radially therefrom.

9. The resistance assembly of claim 8 wherein said loop has spaced apart legs and wherein said first shield means is a surface connected to said first flange to extend circumferentially between the spaced apart legs of said loop for about 30° to about 115° in both directions around the perimeter of said spool.

10. The resistance assembly of claim 8 wherein said second shield means is a surface connected perpendicular to said second flange to extend circumferentially between the spaced apart legs of said loop for about 30° to about 115° in both directions around the perimeter of said securing spool.

11. For use with a machine having movable structure and a first extension member positioned on said movable structure and movable therewith for operation by the user relative to fixed structure having a plurality of second extension members secured thereto each spaced from the other, and said first extension member being a cylindrical shaped finger and said second extension member being a cylindrically shaped finger, a resistance assembly to resist movement of said movable structure, said resistance assembly comprising:

first connecting means for connection to said first extension member on said movable structure, said first connecting means including first securing means to retain said loop thereto and first shield means connected thereto to inhibit movement of said loop away from said first connecting means, and said first connecting means being a spool with a cylindrical aperture formed therein sized to slidably and snugly fit over said first extension member, and said first securing means having a first flange secured to one end of said spool to extend radially outward therefrom, and a securing spool sized to slidably and snugly interconnect with said spool, said securing spool having a second flange appended thereto to extend radially therefrom;

second connecting means for connection to one of said fixed extension members on said fixed structure, said second extension member being movable relative to said first extension member upon movement of said movable structure, said second connecting means including second securing means to retain said loop thereto and second shield means connected thereto to inhibit movement of said loop away from said second connection means; and a loop elastically deformable and positioned about said first connecting means and said second connecting means for elastic deformation upon movement of said first connecting means relative to said second connecting means.

12. In combination, a machine having movable structure with a first extension member secured thereto and movable therewith, said moveable structure being operably by the user relative to fixed structure having a second extension member secured thereto in the performance of exercises, and a resistance assembly to resist movement of said movable structure relative to said fixed structure, said resistance assembly comprising:

first sleeve means for connection to said first extension member, said first sleeve means being sized to snugly and slidably receive said first extension member therethrough;

second sleeve means for connection to said second extension member, said second sleeve means being sized to snugly and slidably receive said second extension member therethrough;

an elastically deformable member positioned about said first sleeve means and said second sleeve means to extend therebetween, said elastically deformable member being elastically deformable upon relative movement of said moveable structure relative to said fixed structure in the performance of exercises.

13. The combination of claim 12 wherein said first sleeve means includes first securing means to retain said sleeve thereto, and wherein said second sleeve means includes second securing means to retain said loop thereto.

14. The combination of claim 13 wherein said first sleeve means has first shield means connected thereto to inhibit movement of said elastically deformable member away from said first sleeve means, and said second sleeve means has second shield means connected thereto to inhibit movement of said elastically deformable member away from said second sleeve means.

15. The combination of claim 14 wherein said first extension member is a cylindrically shaped finger and said second extension member is a cylindrically shaped finger, and wherein said first sleeve means and said second sleeve means each have a cylindrical aperture sized to slidably and snugly fit over said first extension member and said second extension member.

16. The combination of claim 14 wherein said first sleeve means has opposite ends and wherein said first securing means includes a first flange secured to one end of said opposite ends and a second flange secured to the other of said opposite ends.

17. The combination of claim 16 wherein said elastically deformable member has spaced apart legs extending between opposite ends, each of said spaced apart legs having a thickness, a first stretch and a second stretch, and wherein said first flange extends from said first sleeve means a distance selected to receive the thickness of one of said legs and wherein said shield means is a surface connected to said first flange to extend about the perimeter of said flange a portion of the perimeter of said flange to inhibit movement of said elastically deformable member away from said first sleeve means when one of said spaced apart legs separates along its length.

18. The combination of claim 16 wherein said shield extends from said one of said spaced apart legs to another of said spaced apart legs.

* * * * *

UNITED STATES PATENT AND TRADEMARK OFFICE

CERTIFICATE OF CORRECTION

PATENT NO. : 5,135,216

DATED : August 4, 1992

INVENTOR(S) : Curt G. Bingham, S. Ty Measom

It is certified that error appears in the above-identified patent and that said Letters Patent is hereby corrected as shown below:

On the title page, Item [75], Inventor name should be ---Measom---.

Col. 6, line 27 Change "removably" to ---removable---.

Col. 6, line 32 Change "removably" to ---removable---.

Col. 7, line 41 Change "cylindrical" to ---cylindrically---.

Col. 8, line 9 Change "ably" to ---able---.

Signed and Sealed this

Twelfth Day of October, 1993

Bruce Lehman

*Attest:*

BRUCE LEHMAN

*Attesting Officer*

*Commissioner of Patents and Trademarks*